US005105639A

United States Patent [19]

Castricum

[11] Patent Number: 5,105,639

[45] Date of Patent: Apr. 21, 1992

[54] APPARATUS FOR FORMING SPIRAL PIPE

[75] Inventor: Wilhelmus P. H. Castricum, Rolling Meadows, Ill.

[73] Assignee: Spiro America Inc., Wheeling, Ill.

[21] Appl. No.: 487,608

[22] Filed: Mar. 2, 1990

Related U.S. Application Data

[62] Division of Ser. No. 315,373, Feb. 23, 1989, Pat. No. 4,924,684.

[51] Int. Cl.[5] ..... B21C 37/12

[52] U.S. Cl. ..... 72/49; 72/135

[58] Field of Search ..... 72/49, 50, 135; 228/17, 228/17.7, 130, 145, 147, 151

[56] References Cited

U.S. PATENT DOCUMENTS

| | | | |
|---|---|---|---|
| 2,516,817 | 6/1947 | Wernli . | |
| 2,862,469 | 12/1958 | Jensen | 72/49 |
| 3,085,529 | 4/1963 | Admerand | 72/49 |
| 3,132,616 | 5/1964 | Hale | 72/148 |
| 3,268,137 | 5/1965 | Martin | 225/2 |
| 3,538,728 | 11/1970 | Trihey | 72/49 X |
| 3,753,363 | 8/1973 | Trihey | 72/50 |
| 3,753,367 | 8/1973 | Trihey | 72/49 |
| 3,863,480 | 2/1975 | Meserole | 72/50 |
| 4,569,386 | 2/1986 | Mine | 72/49 X |
| 4,706,481 | 11/1987 | Castricum | 72/49 |

FOREIGN PATENT DOCUMENTS

| | | | |
|---|---|---|---|
| 357397 | 10/1980 | Austria . | |
| 885388 | 8/1953 | Fed. Rep. of Germany . | |
| 1121568 | 1/1962 | Fed. Rep. of Germany . | |
| 1123641 | 2/1962 | Fed. Rep. of Germany | 72/49 |
| 2262607 | 10/1975 | France . | |
| 878389 | 11/1981 | U.S.S.R. | 72/49 |
| 642872 | 8/1949 | United Kingdom . | |
| 1513261 | 6/1978 | United Kingdom . | |

OTHER PUBLICATIONS

"Statement Pursuant to 37 C.F.R. §1.97-1.99"; author: James R. Sobieraj; dated May 19, 1989; re U.S. Ser. No. 07/315,373 (Castricum).

EPO Search Report of European Patent App. No. EP 90301443.9, dated Mar. 19, 1990.

EPO Search Report of European Patent App. No. EP 89113808, dated Nov. 6, 1989.

EPO Application No. EP 89113808.

*Primary Examiner*—Lowell A. Larson
*Assistant Examiner*—Michael J. McKeon
*Attorney, Agent, or Firm*—Willian Brinks Olds Hofer Gilson & Lione

[57] ABSTRACT

An apparatus for forming and slitting spirally formed pipe, particularly spiral pipes having a diameter of approximately one inch or less, is disclosed. The pipe forming apparatus includes an enclosed forming head and a mandrel. A continuous strip of metal is driven around the mandrel and inside a lateral bore in the forming head in a helical manner. First and second rollers mounted in the forming head partially form a spiral lockseam. A third roller mounted in the upper portion of the forming head closes the spiral lockseam. The mandrel is both rotatable and pivotable. The device for slitting the spiral pipe into sections includes a first knife that is positioned inside the spiral pipe. This knife is mounted at the endd of a rotatable boom, that extends through the mandrel and is positioned inside of the spiral pipe. A second rotatable knife is positioned outside of the pipe. A rotatable support roller is also positioned outside of the pipe, and opposite the outer knife. To cut the pipe, the outer knife punctures the pipe and overlaps the inner knife, and the support roller abuts the opposite side of the pipe. The inner and outer knives and the support roller move axially with the pipe. As the pipe continues to rotate, it is completely severed.

21 Claims, 8 Drawing Sheets

FIG. 13a
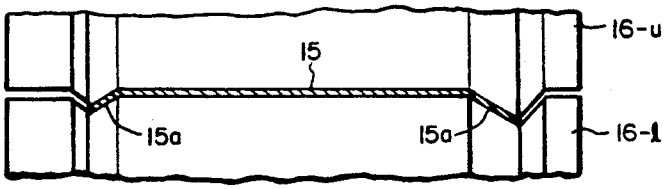
FIG. 13b
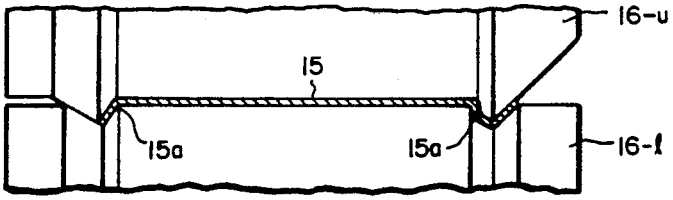
FIG. 13c
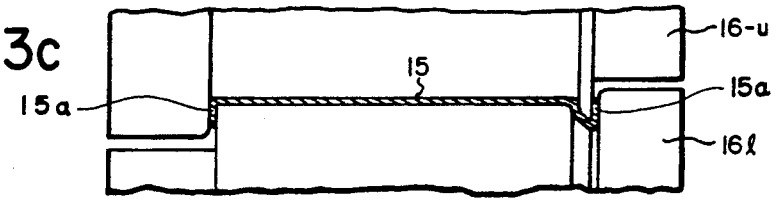
FIG. 13d
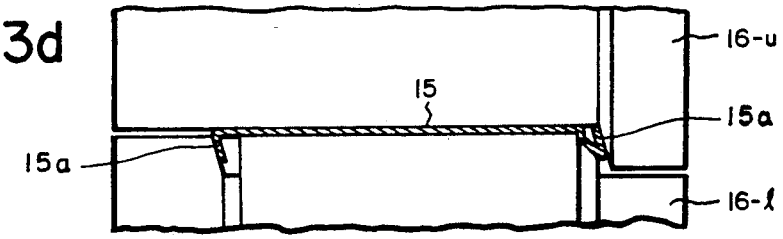
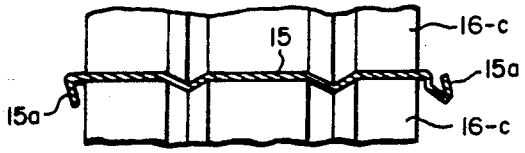
FIG. 13e
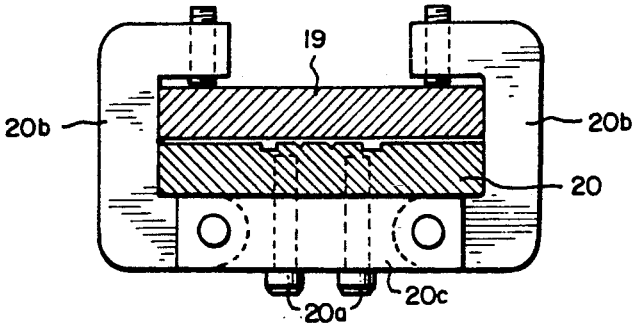
FIG. 14

APPARATUS FOR FORMING SPIRAL PIPE

This is a division of application Ser. No. 315,373, filed Feb. 23, 1989 now U.S. Pat. No. 4,924,684.

BACKGROUND OF THE INVENTION

This invention relates to an apparatus for producing spirally formed pipe, particularly spiral pipes having a diameter of approximately one inch or less.

There are several known ways to form a pipe by spirally or helically winding a continuous strip of metal, and joining adjacent edges of the wound strip to form a spiral lockseam in the pipe One such pipe forming machine is disclosed in my U.S. Pat. No. 4,567,742, issued Feb. 4, 1986. In that machine, a strip of metal is curled inside of a forming head to form a spiral cylinder. A clinching roller comes up through a bottom opening in the forming head and cooperates with a support roller inside the forming head to form the lockseam.

Other types of spiral pipe producing machines are disclosed in U.S. Pat. No. 3,132,616 (Hale), U.S. Pat. No 3,606,779 (Parma), Canadian Patent No. 927,212 and U.K. Patent No. 830 504. The pipes made with these machines are generally used for ventilation and fluid transport. The smallest diameter pipes that are typically made with these machines are a few inches in diameter. These patents do not generally discuss a lower limit on pipe diameter, but there are certainly lower limits because as the pipe diameter decreases, the friction in the forming head or mandrel increases to the point where it is too difficult to move the pipe further.

U S. Pat. No. 3,940,962 (Davis) discloses another type of spiral pipe producing machine, and represents that the disclosed machine can be used to make 1 to 36 inch diameter pipe In practice, however, it would be difficult to accurately produce one inch diameter pipe with the Davis machine because of the roller configuration that it uses to spirally form the pipe. Moreover, it would be difficult to fit both the semi-cylindrical mandrel 67 and anvil roller 47 inside of one inch diameter pipe in accordance with the Davis disclosure.

A large potential for small diameter spiral pipes exists in the filter market, such as automobile oil filters. These filters typically have a perforated inner metal cylinder that is approximately one inch in diameter. In the past, spiral pipes have not been used for these inner filter cylinders because conventional spiral pipe forming machines have not been capable of producing pipe one inch in diameter Hence, for a long time filter pipes have been made in the following, inefficient manner. A metal blank is cut to the precise size needed for the final cylinder. The metal is perforated either before or after the blanking operation. The perforated blank is rolled into a cylinder, and sealed along a longitudinal seam. To prevent the cylinder from collapsing under pressure, the cylinder is corrugated, or a spring is inserted into the cylinder.

The disadvantages of making longitudinal filter pipe in this conventional manner are manifest. Because of various steps involved, continuous pipe production is difficult. Moreover, a different size blank must be used for every change in the diameter and length of the pipe.

SUMMARY OF THE INVENTION

The present invention is directed to apparatus for forming and cutting a spiral pipe having a diameter of one inch or less. In particular, my invention embodies a machine that can produce spiral pipe inside of a lateral bore in a forming head, wherein the spiral pipe can be one inch or less in diameter In a preferred embodiment, my invention embodies a spiral pipe producing machine that includes a forming head that has a lateral bore, and a mandrel that is adapted to be rotationally driven by contact with the moving pipe. The mandrel can also be adapted to be radially pivoted by contact with the moving pipe. The metal strip is formed around the mandrel and inside the lateral bore of the forming head to produce the spiral pipe.

Lockseam forming elements are preferably detached from the mandrel. In a most preferred embodiment of my invention, the lockseam is formed by two sets of roller elements. The first roller elements are mounted in the lower portion of the forming head, and fold the mated edges of the spirally wound strip. The second roller elements are mounted in the upper portion of the forming head, and fully compress the folded edges of the strip to form the lockseam.

My present invention also includes an apparatus for cutting the spiral pipe into sections. The cutting apparatus preferably includes a first rotatable knife to be positioned inside of the spiral pipe, a second rotatable knife to be positioned outside of the pipe, and a support roller to be positioned outside the pipe and opposite the outer knife. To cut the pipe, the outer knife is moved into an overlapping relationship with the inner knife, and the support roller is moved into contact with the pipe. The overlapping knives and support roller will move axially with the pipe and cooperate to cut the pipe as the pipe moves axially and rotates between the overlapping inner and outer knives.

The present invention provides significant advantages over the conventional manner for making longitudinal filter pipes. The pipe diameter and length can be easily varied with the spiral pipe forming and cutting apparatus of my invention. Moreover, spiral pipe approximately one inch in diameter can be made in an enclosed forming head. The enclosed forming head and rotatable mandrel accurately maintain the desired pipe diameter while overcoming the friction problems that have hindered conventional spiral pipe producing machines from making one inch diameter pipe. The present invention also permits the resulting small diameter pipes to be cut by a slitting process.

The invention itself, together with further objects and attendant advantages, will be best understood by reference to the following detailed description taken in conjunction with the drawings.

BRIEF DESCRIPTION OF THE DRAWINGS

FIGS. 13*a*–13*e* are sectional views of the edge forming and corrugation rollers that are used in the spiral pipe forming machine which is used with the preferred embodiment of the present invention, with the strip edge configuration illustrated between the rollers.

FIG. 14 is a sectional view of the guide plates and clamping members that are used in the spiral pipe forming machine which is used with the preferred embodiment of the present invention.

DETAILED DESCRIPTION OF A PREFERRED EMBODIMENT

Figure 1:
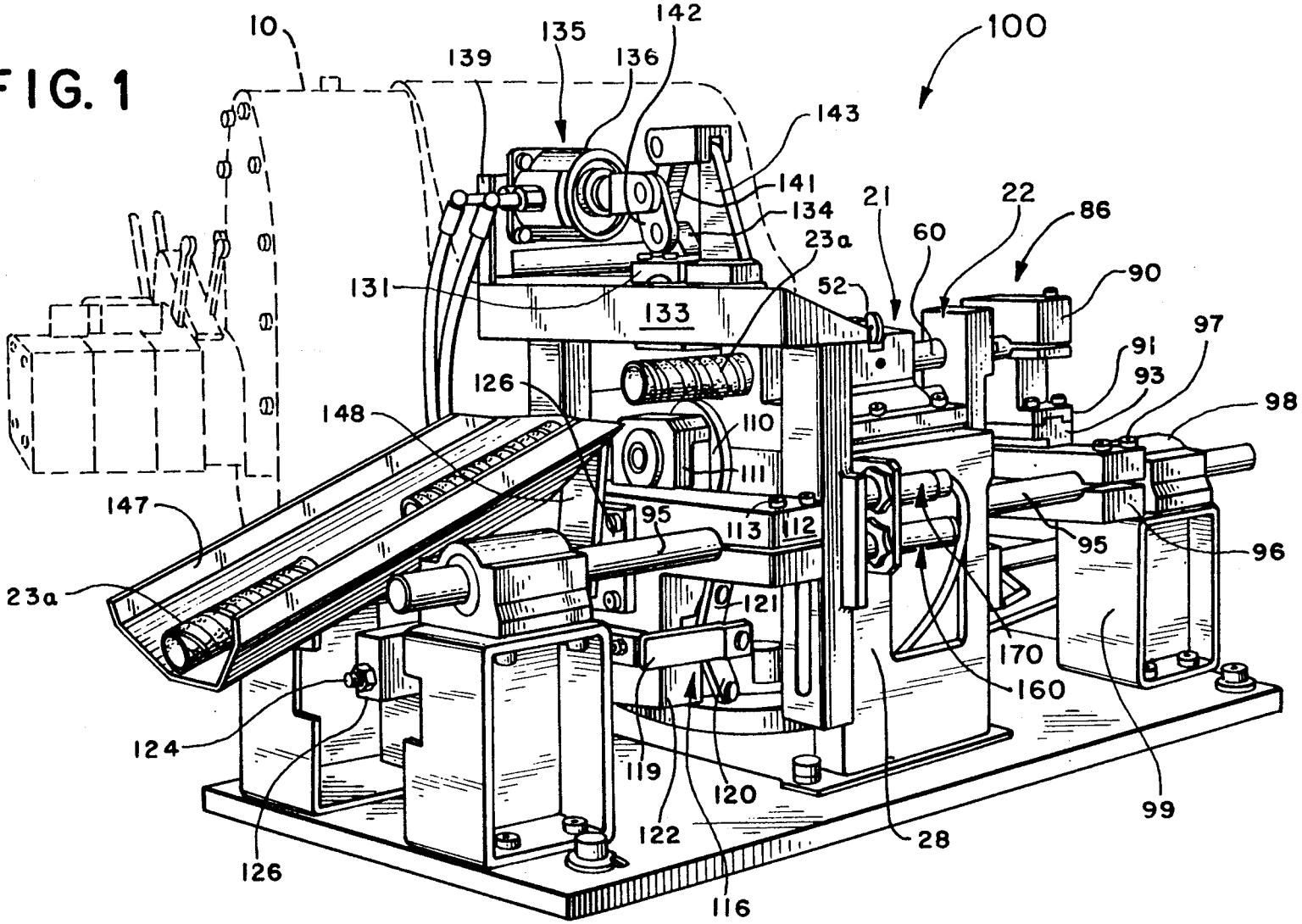
FIG. 1 is a perspective view of the back and right sides of the preferred embodiment of the present invention.
Figure 2:
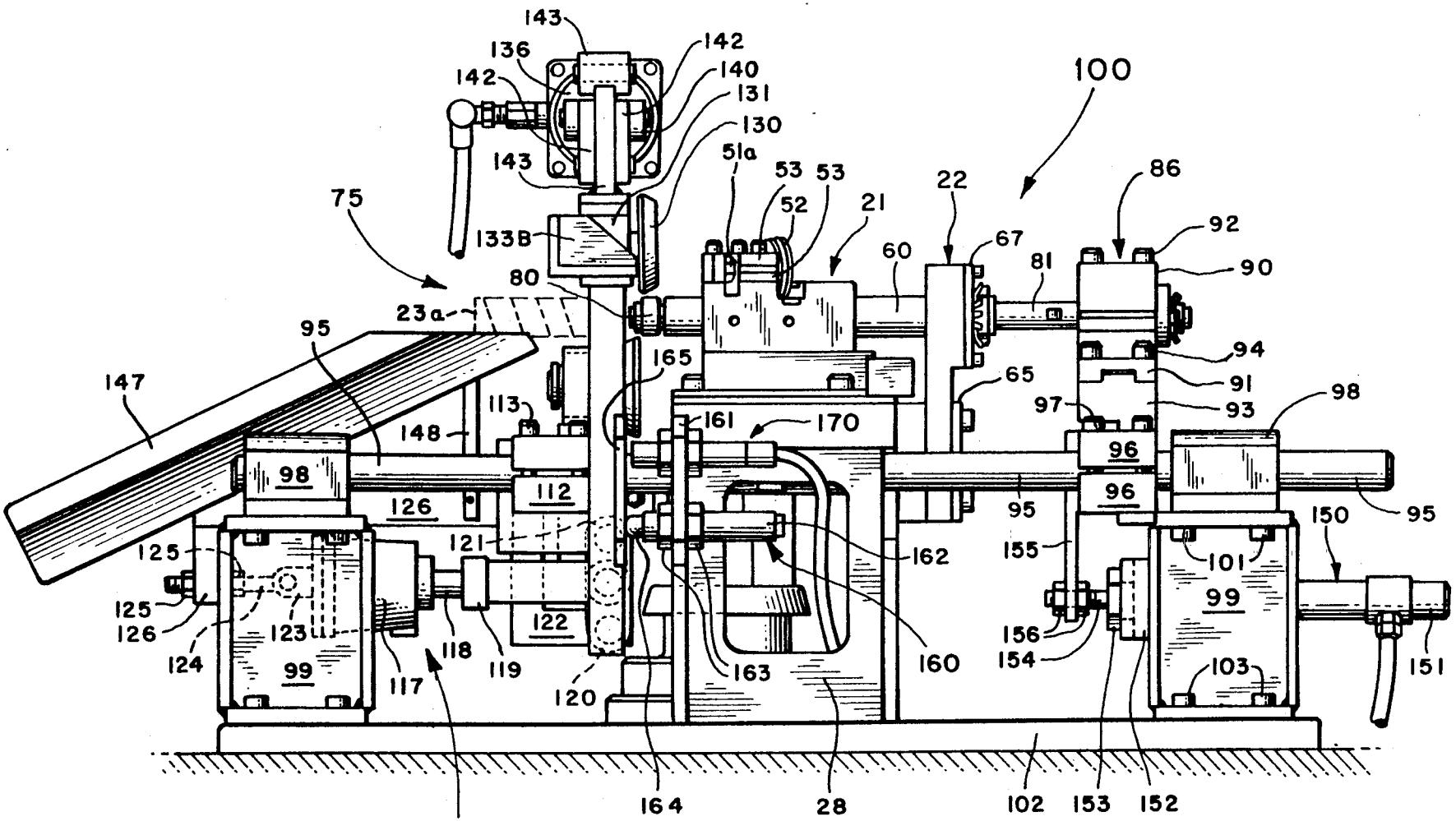
FIG. 2 is an elevation view of the back side of the preferred embodiment of the present invention.

Referring now to the drawings, FIGS. 1 and 2 show the combination 100 of the spiral pipe forming apparatus 10 and improved slitter 75 of the present invention. Many elements of the pipe forming machine 10 are conventional, and are described in greater detail in my U.S. Pat. No. 4,567,742, issued Feb. 4, 1986. The description of the pipe forming apparatus disclosed in that patent is incorporated by reference herein, and made a part hereof. Many of the parts disclosed therein can be used in the present tubeformer 10 with some adaptation to accommodate the one and one-half inch wide strip 15 and its particular edge and corrugation configurations that are used in the present tubeforming machine 10.

Figure 12:
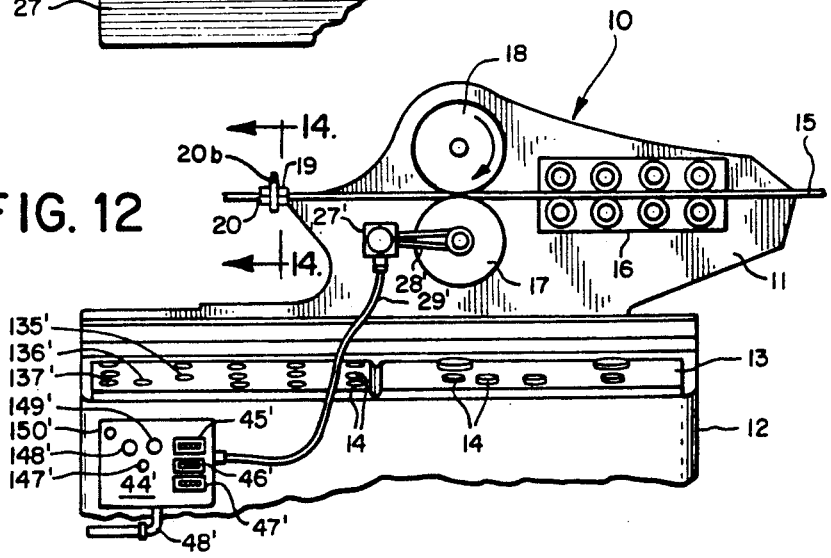
FIG. 12 is a side elevation view of a part of a spiral pipe forming machine which is used with the preferred embodiment of the present invention.

FIG. 12 shows some of the elements of the pipe forming machine 10. The machine includes a frame 11 and a control cabinet 12. A control panel 13 contains a plurality of control elements 14, such as knobs, gauges and dials, for controlling and monitoring the operation of the pipe forming machine 10 and the slitter 75. The functions of the various control elements are described in my U.S. Pat. No. 4,706,481, issued Nov. 17, 1987, and my pending U.S. patent application, Ser. No. 139,678, filed Dec. 30, 1987. The descriptions of the control elements contained in that patent and patent application are incorporated by reference herein, and made a part hereof.

A continuous metal strip 15 is fed into the frame 11 of the pipe forming machine 10. To make one inch diameter filter pipe, the strip 15 is preferably 1.5 inches wide and perforated. The strip 15 can be perforated before entering the pipe forming machine 10, or by a perforating drive roller in the pipe forming machine 10. If the pipe diameter increases, a wider strip 15 can be used and is preferred.

The metal strip 15 passes through a roller housing 16 that contains a plurality of rollers that bend the edges of the strip 15*a* into a predetermined shape for forming the lockseam, and that form corrugation grooves in the metal strip. FIGS 13*a*–13*e* show the upper edge forming rollers 16–*u*, the lower edge forming rollers 16–*l*, and corrugation rollers 16–*c* that are preferably used for forming the strip edges and corrugations for forming one inch diameter filter pipe. The strip 15 first passes through the rollers shown in FIG. 13*a*, and successively through the rollers shown in FIG. 13*b* through FIG. 13*e*. Further information about the function and operation of the edge forming rollers and corrugation rollers is disclosed in my U.S. Pat. No. 4,567,742, which is incorporated by reference herein and made a part hereof.

A lower drive roller 17 and an upper drive roller 18 are rotatably mounted in the frame 11. The drive rollers cooperate to pull the metal strip 15 into the frame 11 and through the roller housing 16. The two drive rollers 17, 18 then push the metal strip 15 between the upper guide plates 19 and lower guide plates 20. The width of the drive rollers 17, 18 and the guide plates should be adapted to conform to the width of the strip 15. As shown in FIG. 14, the lower guide plates 20 are secured to the frame 11 by bolts 20*a*. The lower guide plate 20 also contains grooves to accommodate the corrugations and edges formed in the strip 15. Clamps 20*b* are pivotally connected to a base 20*c* that is attached to the frame 11. The clamps 20*b* hold the upper guide plates 19 against the lower guide plates 20.

Referring now to FIGS. 1 through 5, a forming head assembly 21 and a mandrel assembly 22 cooperate to form the metal strip 15 into a spiral pipe 23. The forming head assembly 21 includes a base 27 which is detachably secured to a forming head table 28. A clamp 26 is used to secure the forming head base 27 to the forming head table 28.

As best shown in FIGS. 6 through 10, the forming head assembly 21 also includes a forming head 29 which is bolted to the forming head base 27. The forming head 29 is enclosed around a lateral bore 30. The metal strip 15 is formed inside of the lateral bore 30 into a spiral pipe having a diameter of approximately one inch. Helical grooves 31 are cut into the forming head 29 to accommodate the corrugations on the helically-wound strip and the spiral pipe 23. Deeper helical grooves 32 are provided for the formed edges 15*a* of the strip 15 and the resulting lockseam 24. (See also FIG. 3) The inner grooves 31 and 32 help guide the helically-wound strip 15 and spiral pipe 23 through the forming head 29. The inner diameter of the lateral bore 30 determines the outer diameter of the spiral pipe 23. If the diameter of the spiral pipe is to be varied, a forming head 29 with a different diameter lateral bore 30 should be used. Interchangeable forming heads with different diameter lateral bores can be used in the preferred embodiment of the present invention. It is generally preferred that the pipe forming apparatus of the present invention will be used to make spiral filter pipe one to two inches in diameter from a one and one-half inch wide perforated metal strip 15. It is expected that spiral pipe as small as seventh-eighths of an inch ($\frac{7}{8}$ inch) in diameter can be made with the pipe forming apparatus 10 of the present invention. Of course, the present invention is not limited to making perforated filter pipe.

The forming head 29 mates with a removable inset 33. The inset 33 is held in place by pins (not shown). The radius of curvature of the removable inset 33 is smaller than the radius of curvature of the lateral bore 30. The inner surface of the removable inset 33 can be coated with a friction reducing material. The removable inset 33 is intended to prevent the metal strip 15 from locking up as it is driven around the lateral bore 30 of the forming head 29.

Figure 3:
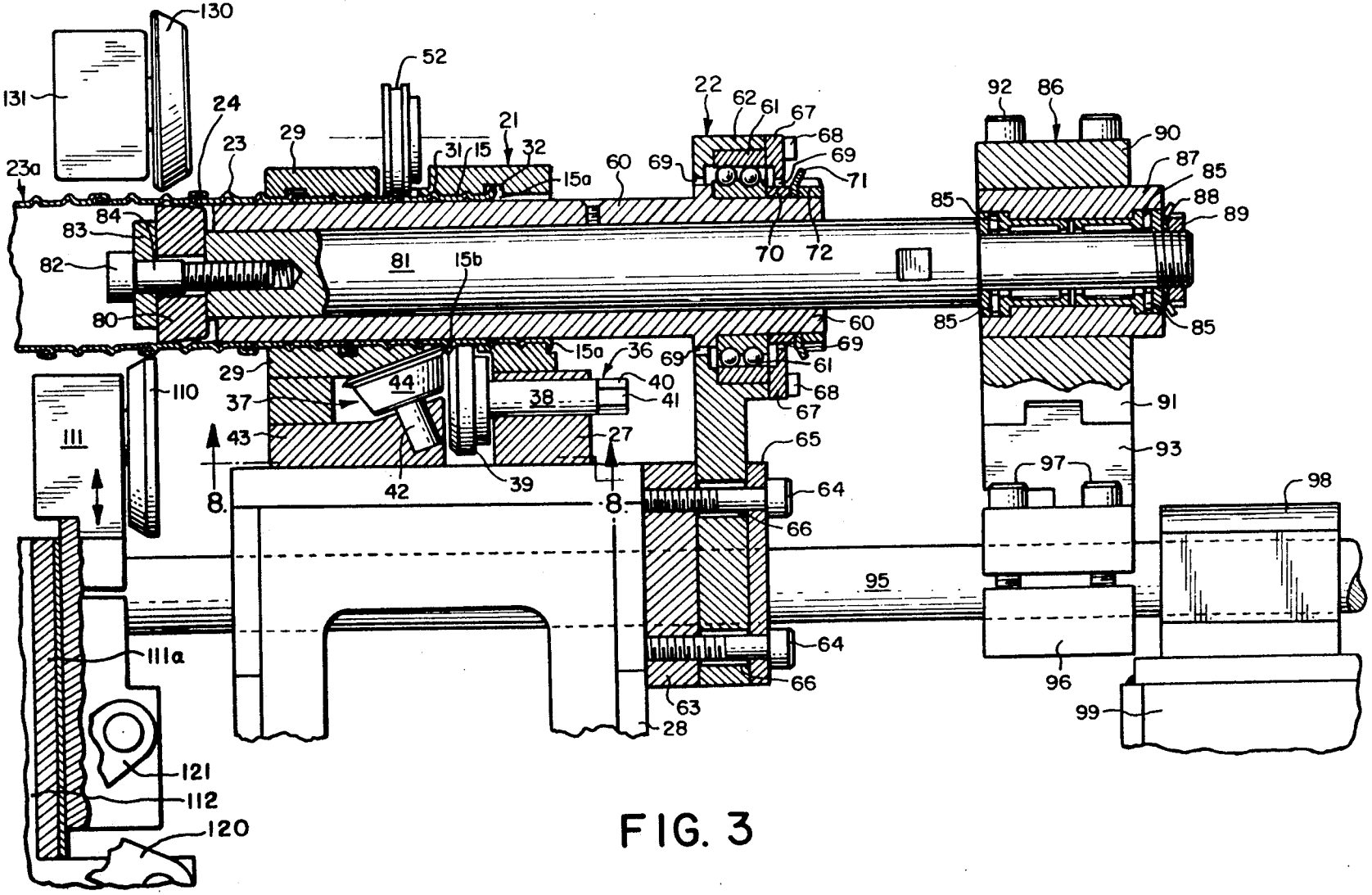
FIG. 3 is a view, partially in elevation and partially in section, of part of the back side of the preferred embodiment of the present invention.
Figure 4:
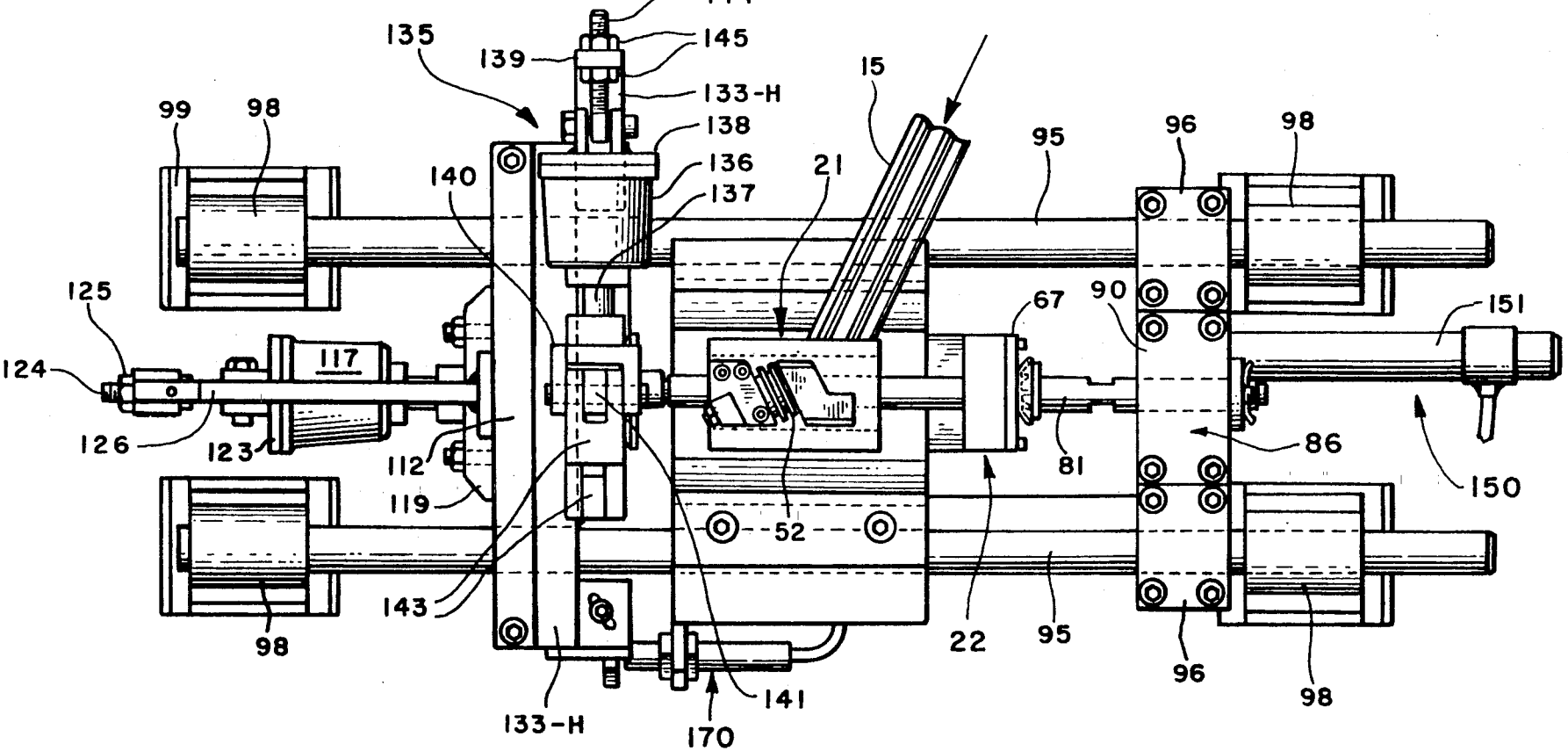
FIG. 4 is a plan view of the preferred embodiment of the present invention.
Figure 5:
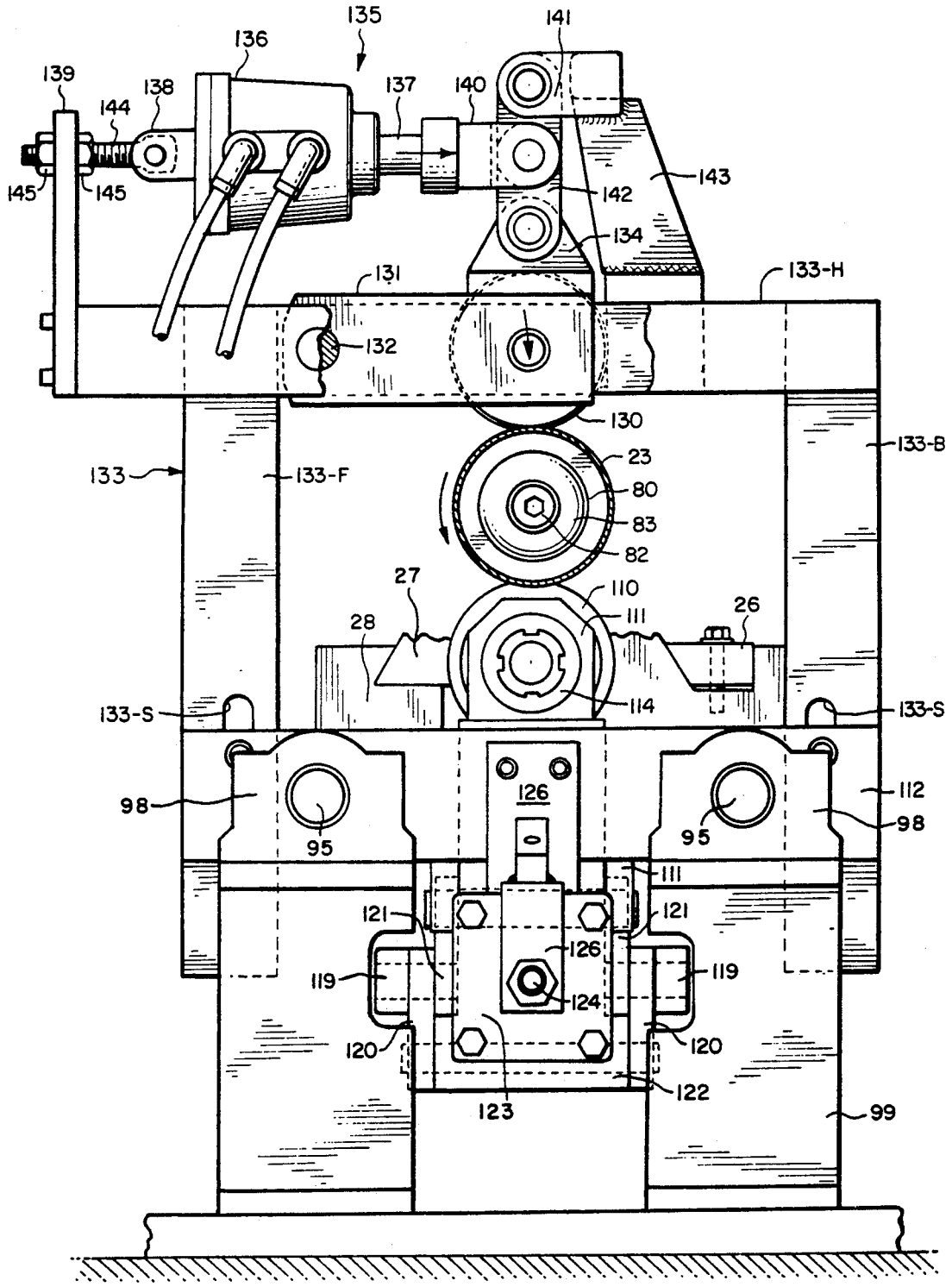
FIG. 5 is an elevation view of the right side of the preferred embodiment of the present invention.
Figure 6:
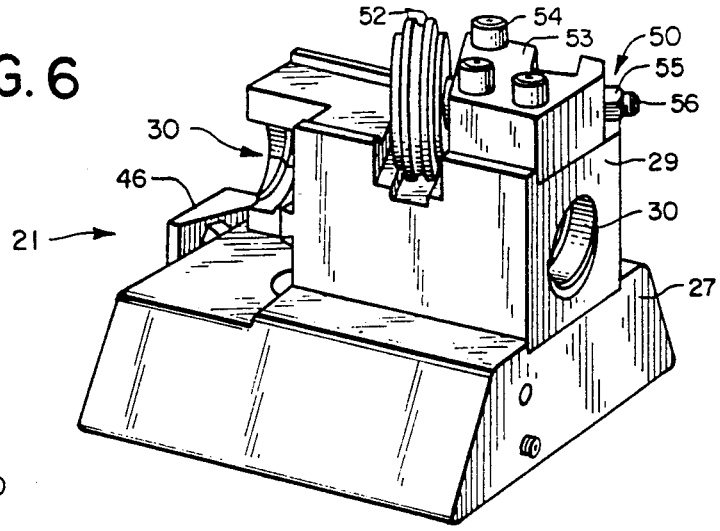
FIG. 6 is a perspective view of the front and right sides of the forming head assembly of the preferred embodiment of the present invention.
Figure 8:
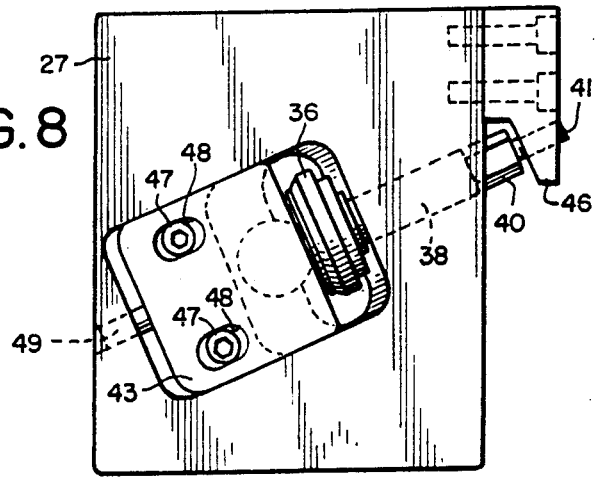
FIG. 8 is a plan view of the bottom side of the forming head assembly of the preferred embodiment of the present invention, and is taken along lines 8—8 of FIG. 3.
Figure 9:
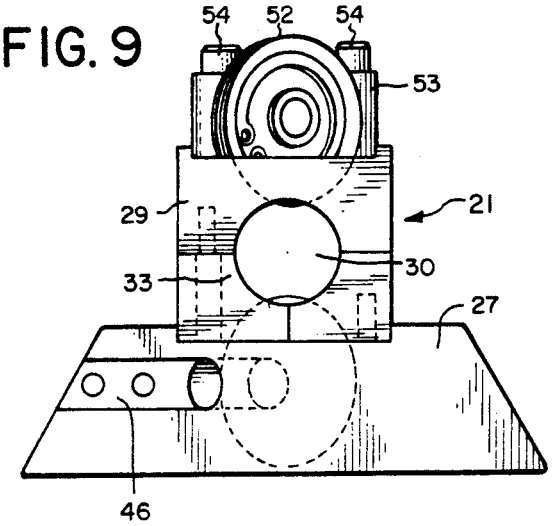
FIG. 9 is an elevation view of the left side of the forming head assembly of the preferred embodiment of the present invention.
Figure 10:
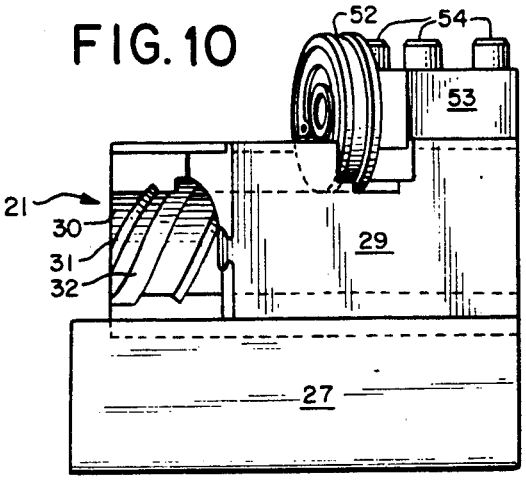
FIG. 10 is an elevation view of the front side of the forming head assembly of the preferred embodiment of the present invention.
Figure 11:
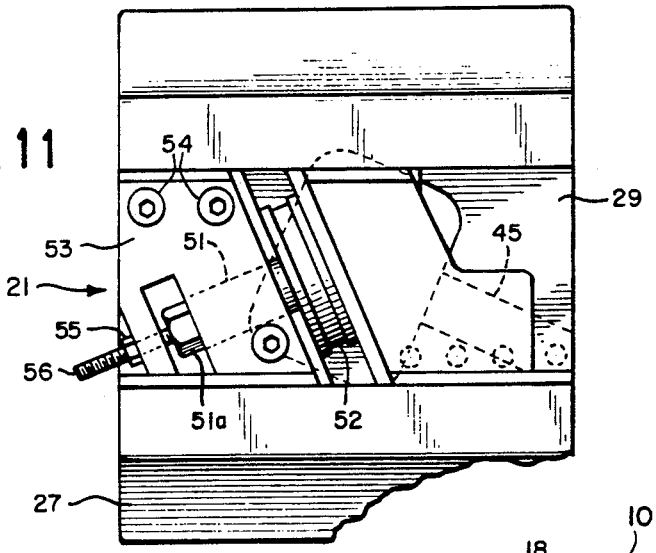
FIG. 11 is a plan view of the top side of the forming head assembly of the preferred embodiment of the present invention.

As shown in FIG. 3, a pair of folding rollers 36 and 37 are located in the base 27 of the forming head assembly 21. These rollers cooperate to fold or partially compress the mated edges 15*b* of the strip 15 as it is helically wound into a spiral cylinder in the forming head bore 30. The first folding roller 36 has a shaft 38 that is fixed within a laterally angled bore 45 in the forming head base 27. The correct orientation of the laterally angled bore 45 is best shown in FIGS 8 and 11. In FIG. 3, the first folding roller 36 is shown rotated from its correct angular orientation to better illustrate how the folding rollers 36, 37 cooperate to fold the mated edges 15*b* of the helically wound strip.

Figure 7:
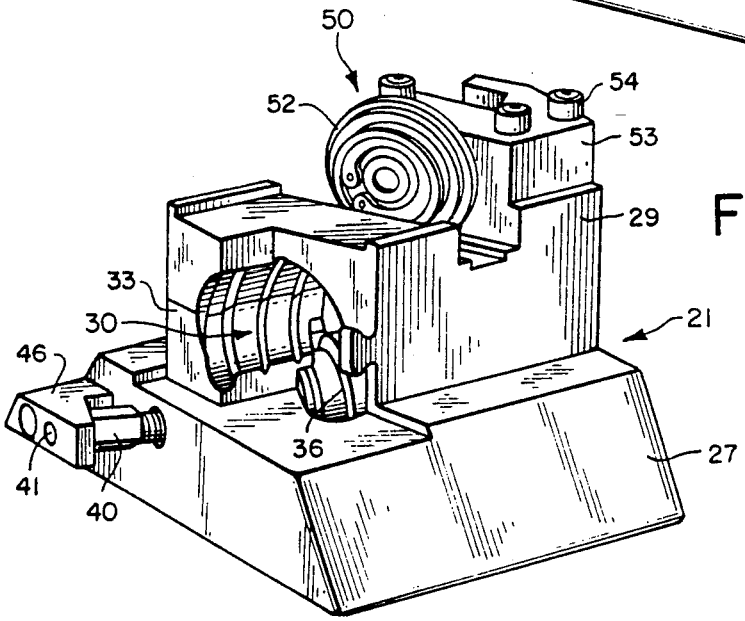
FIG. 7 is a perspective view of the front and left sides of the forming head assembly of the preferred embodiment of the present invention.

The first roller head 39 protrudes through an opening in the bottom of the forming head 29 and contacts the overlapping, helically wound strip edges 15*b*. (See FIG. 3) The roller head 39 is rotationally attached to an end of the shaft 38. Bearings inside the roller head 39 allow the roller head to be passively rotatable around the shaft 38. That is, the roller head is not positively driven, such as by a motor; the roller head 39 is rotationally driven by frictional contact with the spirally rotating strip 15. The roller shaft 38 is eccentric, so that the height of the roller head 39 can be adjusted relative to the helically wound strip 15. As shown in FIGS. 7 and 8, the end of the shaft that protrudes from the base 27 has a hexagonal end 40 that can be rotated to provide the eccentric adjustment. A set screw 41 is provided to axially adjust the roller head 39 closer to or farther from the overlapping, helically wound strip edges 15*b*. The set screw 41 is positioned within an axial adjustment block 46 that is bolted to the forming head base 27.

The correct angular orientation of the second folding roller 37 is shown in FIG. 3. The second folding roller 37 has a shaft 42 that is press fit into a vertically inclined bore in a roller holder 43. The lower portion forming head base 27 is carved out to permit the roller holder 43 and the second folding roller 37 to slide in and out. The roller holder 43 is held in place against the forming head table 28 by bolts 47. (See FIG. 81) Oval slots 48 and a set screw 49 allow the second folding roller head 44 to be adjusted laterally with respect to the overlapping helically wound strip edges 15*b*. Bearings inside the roller head 44 allow the roller head to be passively rotatable around the upper end of the shaft 42. The second roller head 44 also protrudes through an opening in the bottom of the forming head 29 and contacts the overlapping, helically wound strip edges 15*b*.

A lockseam closing roller assembly 50 is positioned on top of the forming head 29. The rotational axis of the lockseam roller head 52 is orientated in a laterally angled position, as shown in FIGS. 6–11. In FIG. 3, the lockseam roller head 52 is shown rotated from its correct angular orientation to better illustrate how it fully compresses the folded edges of the helically wound strip to form the lockseam 24.

The lockseam closing roller head 52 protrudes through an opening in the top of the forming head 29 and contacts the folded, helically wound strip edges. The roller head 52 is rotationally attached to an end of a shaft 51. Bearings inside the roller head 52 allow the roller head to be passively rotatable. The shaft 51 passes through an upper roller holder 53 that is attached to the top of the forming head 29 by threaded bolts 54. The roller shaft 51 is also eccentric and has a hexagonal end 51*a* that can be accessed through an opening in the upper roller holder 53 (See FIG. 11) The lockseam roller head 52 can be adjusted vertically relative to the helically wound strip 15 by turning the hexagonal end 51*a* of the shaft 51. A set screw 56 adjusts the lockseam roller head 52 axially with respect to the folded, helically wound strip edges. A nut 55 holds the set screw 56 in place.

As shown in FIGS. 1–3, the spiral pipe 23 is not only formed inside the enclosed forming head 29, but at the same time is formed around a completely cylindrical mandrel 60. The clearance between the mandrel 60 and the surface of the lateral bore 30 in the forming head 29 is approximately twice the thickness of the metal strip, plus 0.006–0.003 inches each side. The closely controlled clearance between the mandrel 60 and enclosed forming head 29 provides greater accuracy in producing pipe having a consistent diameter. If there is too much clearance, the strip 15 will buckle in the the forming head. If there is too little clearance, the strip 15 will lock up inside the forming head.

To overcome the friction that usually precludes the production of small diameter spiral pipe (i.e., approximately one inch diameter), the mandrel 60 is both rotatable and pivotable. Bearings 61 permit the mandrel to be passively rotatable, i.e., rotationally driven by contact with the spirally moving strip 15 or pipe 23. The bearings 61 are mounted in a vertical holder 62, which is secured between a mounting block 63 and cover plate 65 by bolts 64. The mounting block 63 is attached to the central area of the forming head table 28. The vertical holder 62 contains oversized openings 66 which permit the position of the mandrel 60 to be adjusted vertically and laterally. The bearings 61 are held in place by a cover 67 and bolts 68. The vertical holder 62 and the cover 67 have annular openings 69 that are larger in diameter than the mandrel 60. The annular openings 69 and bearings 61 cooperate to permit the mandrel 60 to pivot radially in all directions. A spacer ring 70 is provided to make the extent of pivotal travel the same in all directions. A lock washer 71 and lock nut 72 are attached to the end of the mandrel, and prevent any axial movement by the mandrel 60. The foregoing elements of the mandrel assembly 22 thus cooperate to permit the mandrel 60 to rotate and pivot within the forming head lateral bore 30 in response to pressure exerted by the spirally moving strip 15 or pipe 23. The mandrel 60 is thus free-floating inside of the spirally moving strip or pipe, and can center itself therein with minimal friction. It should be noted that for heavier gauge metal and stainless steel it may be preferable to positively drive the mandrel 60, for example, by a combination of a timing belt and hydraulic motor. When the motor mandrel is driven, it must be at a speed greater than the speed of strip driven past the mandrel.

The preferred embodiment of the present invention also includes an apparatus for slitting the spiral pipe made with the pipe forming apparatus 10. The present slitting apparatus 75 includes many elements of the slitting apparatus disclosed in my co-pending patent application, Ser. No. 139,678, filed Dec. 30, 1987, and my U.S. Pat. No. 4,706,481. The descriptions of the slitting apparatus contained in that patent application and patent are incorporated by reference herein and made a part hereof. Indeed, the differences between those slitters and the present slitter generally relate to the small diameter pipe that is made and cut with the present invention.

Referring now to FIGS. 1-5, an inner knife 80 is attached to a boom S1 with a bolt 82. A washer 83 is positioned between the bolt 82 and the inner knife 80. The inner knife 80 has an oversized central opening 84, which permits the position of the inner knife to be adjusted in any radial direction relative to the inner surface of the spiral pipe 23. In general, the inner knife 80 will be centered within the spiral pipe 23. It is most preferred that the inner knife can be centered within the pipe without an oversized opening 84.

The boom 81 passes through the mandrel 60, and is free floating within the mandrel 60. Thus, the boom 81 does not necessarily rotate with the mandrel, but is designed to rotate only during this slitting process. The boom is preferably passively rotatable, i.e., it is rotationally driven by the overlapping inner knife 80 and outer knife 110 during the slitting process. To provide the passive rotation, the end of the boom 81 opposite the inner knife 80 is surrounded by combination needle/-thrust bearings 85. These needle/thrust bearings 85 can be obtained from IKO Bearings, of Arlington Heights, Ill. The bearings 85 are held in a boom holder assembly 86 by an annular support member 87, a lock washer 88, and a lock nut 89.

The boom holder assembly 86 has an upper section 90 and a lower section 91. Each section has a central semi-cylindrical cavity which abuts the annular support member 87. The upper section 90 and the lower section 91 are clamped to each other by a plurality of allen bolts 92. The lower section 91 is mounted on an attachment block 93, and fixed thereto by allen bolts 94. The attachment block 93 passes between guide shafts 95, and is secured to a shaft connector 96 by allen bolts (not shown). A plurality of allen bolts 97 squeezed together the ends of the shaft connector 96 around the guide shafts 95, so that the shaft connector 96 slides axially with the guide shafts 95. The guide shafts 95 pass through openings in the forming head table 28, and slide through the bearing housings 98, which include THK Slide Bearing SC 25 assemblies. There are four such bearing housings 98, each of which is attached to the top of a mounting leg 99 by allen bolts 101. The four mounting legs 99 are provided to support the mandrel assembly 22 and the slitting apparatus 75 at the correct height with respect to the forming head table 28 and the pipe 23. The mounting legs 99 are attached to the base plate 102 by allen bolts 103. The base plate 102 is attached to the pipe forming machine 10. Oval pivot slots (not shown) are provided in the base plate 102, so that the pipe cutting apparatus can be pivoted about the center of the inner knife 80. Most of the bolts that connect the various components of the boom assembly 86 pass through oval slots so that the position of the components can be adjusted relative to each other.

An outer knife 110 is generally positioned below the inner knife 80 and outside of the pipe 23. The outer knife is held in a vertical holder 111 by a lock washer and lock nut 114 that are connected to the shaft of the knife. Bearings (not shown) permit the outer knife 110 to be passively rotatable, that is, rotationally driven by contact with the rotating pipe 23. The vertical holder 111 is attached to a slide bearing assembly 111*a*, (e.g., THK Roller Table Type VRM 3105A). The slide bearing assembly 111*a* is also attached to the central portion of a knife slide block 112. The vertical holder 111 and outer knife 110 can thus slide up and down relative to the knife slide block 112. The knife slide block 112 has two cylindrical openings through which the guide shafts 95 pass. A plurality of allen bolts 113 squeeze together the sides of these openings around the shafts 95, so that the knife slide block 112 is also affixed to and slides axially with the guide shafts 95.

During the pipe forming process, the outer knife 110 must be maintained in a standby position, where it will not interfere with the spirally moving pipe 23. When it is time to cut the pipe, the outer knife blade is moved to a cutting position, where it punctures the spiral pipe 23 and overlaps the inner knife 80 (see, e.g., FIG. 5).

The outer knife blade 110 is moved into and out of its cutting position by the pneumatic cylinder assembly 116. This assembly includes a pneumatic cylinder 117 that controls a piston 118. A lower clevis 119 is attached to the piston 118 and a set of links 120, 121. The lower links 120 are pivotally connected to the clevis 119 and an arm 122 which is integral with and extends from the central portion of the knife slide block 112. The upper toggle links 121 are pivotally connected to the clevis 119 and the bottom of vertical holder 111. Thus, when the piston 118 is fully extended, the vertical holder 111 and lower knife 110 will be raised vertically into the cutting position where the cutting edges of the inner and outer knives overlap and puncture the pipe 23. (See FIGS. 2 and 5) When the piston 118 is retracted into the cylinder 117, the toggle links 120 and 121 will collapse and pull down the vertical holder 111 and the outer knife 110 to the standby position. (See FIG. 1).

An upper clevis 123 is attached to the top of the cylinder 117. The upper clevis 123 is pivotally connected to a threaded shaft 124. Nuts 125 secure the threaded shaft 124 to one end of a cylinder support bracket 126. The other end of the cylinder support bracket 126 is attached to the central position of the knife slide block 112. (The vertical holder 111 and slide bearing assembly 111*a* are connected to the opposite side of the knife slide block 112.) As a result of its connection to the knife slide block 112, the cylinder support bracket 126 and other components of the pneumatic cylinder assembly 116 move axially with the guide shafts 95. The threaded shaft 124 of the pneumatic cylinder assembly 116 permits adjustment of the standby and cutting positions of the lower knife 110.

The slitting apparatus 75 of the present invention also includes a support roller 130. The shaft of the support roller is mounted in one end of a roller holder 131, which contains bearings that permit the support roller to be passively rotatable. The other end of the roller holder 131 pivots around a pin 132 that is secured in an upper roller bracket 133. During the pipe forming process, the support roller 130 is maintained in a standby position where it will not interfere with the spirally moving pipe 23 (see, e.g., FIG. 3). When it is time to cut the pipe and the outer knife 110 is moved to its cutting position, the support roller 130 is simultaneously moved to its extended position, where it contacts the top side of the spiral pipe (see, e.g. FIG. 5). The support roller 130 is positioned outside of the pipe and 180 degrees opposite the outer knife 110. The support roller 130 thus operates to prevent the boom 81 from deflecting upward in response to the force exerted by the lower knife 110. With small diameter pipes (i.e., approximately 1 inch), it is more difficult to keep the boom 81 rigid. If the boom 81 moves away from the pipe, the inner and outer knives will not overlap and cut the pipe. The support roller 130 thus maintains the inner and outer knives in an overlapping relationship during the slitting process.

The support roller 130 is moved into and out of its standby position by the pneumatic cylinder assembly 135. The pneumatic cylinder assembly 135 includes a cylinder 136 and a retractable piston 137. A clevis 138 is attached to the top of the cylinder 136 and to a vertical support member 139 via threaded shaft 144. The vertical support member 139 is bolted to upper roller bracket 133. The piston 137 is attached to a lower clevis 140. An upper link 141 and two lower links 142 are pivotally connected to the lower clevis 140. The upper link 141 is also pivotally connected to an upper toggle bracket 143, which is attached to the upper roller bracket 133. The lower links 142 are pivotally connected to a support roller bracket 134, which is attached to the roller holder 131. Thus, when the piston 137 retracts, the support roller 130 will be pulled up and away from the spiral pipe 23, and into its standby position (See FIG. 1). When the piston 137 is fully extended, the support roller 130 will be pushed into contact with the spiral pipe 23. (See FIG. 5) The standby and extended positions of the support roller 130 can be adjusted via the threaded shaft 144 and the nuts 145.

The upper roller bracket 133 actually consists of two vertical members 133-F and 133-B that are connected to opposite ends of the knife slide block 112. An overhead member 133-H is bolted to the tops of the two vertical members 133-F and 133-B. The bolts pass through oval slots in the overhead member 133-H, which permit angular adjustment of the support roller position. It is overhead member 133-H to which the upper pneumatic cylinder assembly 135 is connected via its vertical support member 139 and upper toggle bracket 143. Each vertical member of the upper roller bracket 133 includes oval slots 133-S. These oval slots 133-S permit the height of the overhead member 133-H, and hence the standby and contact positions of the support roller 130, to be adjusted. The support roller 130 also moves in the axial direction of the pipe during the cutting operation because the upper roller bracket 133 is connected to the guide shafts 95 via the knife slide block 112.

A slide 147 is provided to catch pipe sections 23*a* that have been severed by the slitter apparatus 75. The slide 147 has a vertical flange 148 that is connected to the cylinder support bracket 126. Thus, the slide 147 also moves in unison with the cutting knives 80, 110 and support roller 130 during the cutting operation.

When the outer knife 110 punctures the pipe 23 and overlaps the inner knife 80, the guide shaft system allows the axially moving pipe to push the overlapping knives and the support roller, and their connected components, in unison with the pipe. An axial motion cylinder assembly 150 is provided to assist the axial movement of the pipe cutting apparatus 75. As best shown in FIG. 2, this assembly 150 includes a pneumatic cylinder 151 which is supported by a piece of flat stock 152, and held in place by a nut 153. The flat stock 152 is attached to a mounting leg 99. The piston 154 is secured to a second piece of flat stock 155 by a pair of nuts 156. The second piece of flat stock 155 is bolted to the central inner portion of the shaft connector 96. When air is supplied to the cylinder 151 in one direction, the piston 154 extends out of the cylinder, and pushes the shaft connector 96, and its connected components, in the axial direction of the pipe 23. When the air to the cylinder 151 is reversed, the piston 154 retracts and pulls the inner and outer knives 80, 110, back to their starting or "begin-cut" position. The air supplied to the cylinder assembly 150 is adjusted to assure that the knives 80, 110 and support roller 130 move at the same axial speed as the pipe 23 so that a clean, rectangular cut is obtained.

A stop/shock-absorber mechanism 160 is provided to fix the begin-cut position of the inner and outer knives. (See FIG. 2) This mechanism comprises a mounting plate 161 which is attached to the forming head table 28. A commercially available hydraulically-dampened plunger 162 extends through the mounting plate 161 in the axial direction of the pipe. The plunger 162 is held in place by nuts 163, which mate with the threaded portions of the plunger 162. A plastic tip 164 is mounted on the piston (not shown) of the plunger 162. The stop/-shock-absorber assembly 160 serves two functions. First, it serves as a stop, which sets the begin-cut position of the pipe slitting apparatus 75. When the axial motion of the piston 154 fully retracts, a strip of flat stock 165 attached to the upper roller bracket 133 comes to rest against the plastic tip 164 of the fully retracted plunger 162 as shown in FIG. 2. Thus, the nuts and threaded portions of the plunger 162 can be adjusted to set the begin-cut position. Second, when the piston 154 extends and pushes the upper roller bracket 133 and flat strip 165 away from the stop/shock-absorber mechanism 160, a spring (not shown) in the plunger 162 pushes its piston (not shown) and plastic tip 164 out of the plunger 162. When the upper roller bracket 133 and flat strip 165 return to the begin-cut operation, they will push the plastic tip 164 and its piston into the plunger 162, until the upper roller bracket 133 returns to the begin-cut position. While the piston is pushed back into the plunger 162, it provides a hydraulic cushion or shock-absorber effect on the upper roller bracket 133 and its connected components.

A proximity sensor 170 is also mounted in the mounting plate 161 adjacent to the stop/shock absorber mechanism 160. The proximity sensor 170 is connected to the slitter control circuit, and prevents the slitting process from beginning if the slitter is not all the way back in its begin-cut operation. If the slitter is not in its begin-cut position and the slitting process begins, the axial motion piston 154 will reach its end of travel before the pipe 23 is fully severed.

It may be noted that many of the components of the pipe forming apparatus 10 and slitter apparatus 75 are made of toolsteel (58°-62° HRC), CRS or Mehanite.

The operation of the pipe forming apparatus 10 and slitter apparatus 75 of the preferred embodiment of the present invention will now be described. The operation is similar in many respects to that described in detail in my U.S. Pat. No. 4,567,742 and U.S. Pat. No. 4,706,481. The descriptions of the operation of the apparatus disclosed in those patents are incorporated by reference herein and made a part hereof.

In the combination pipe former/slitter 100 a perforated strip of metal 15 is pulled into the roller housing 16 by the drive rollers 17 and 18. In the roller housing 16, the strip is corrugated and the edges of the strip are formed in the shapes desired to produce a spiral lockseam. Drive rollers 17 and 18 then push the corrugated and edged formed strip through the guide plates 19 and 20 and into the forming head assembly 21. The strip is driven around the rotatable mandrel 60 and inside the lateral bore 30 of the forming head 29. The metal strip is driven between the mandrel 60 and forming head 29 in a helical manner, so that the outer edges of the strip are positioned adjacent to each other in helical fashion. The folding rollers 36 and 37 cooperate to fold the adjacent, mated edges of the helically wound strip. The lockseam closing roller 52 compresses the folded strip edges against the mandrel 60 to form a tight lockseam 24. During the pipe forming operation, the mandrel 60 is passively rotatable and pivotable, thereby eliminating friction that might otherwise cause the helically wound strip and pipe to lock up between the mandrel 60 and forming head 29.

As the spiral pipe production continues, the pipe 23 moves out of the forming head block 29 in a helical fashion. That is, the pipe 23 moves in its axial direction while it rotates. During the pipe production process, the outer knife 110 and the support roller 130 are in their standby positions, as well as in the begin-cut position. Thus, all of the pneumatic cylinder assemblies 116, 135, and 150 have their respective pistons fully retracted. When the pipe 23 reaches its desired length, air is sent to all three of these pneumatic cylinder assemblies to fully extend their respective pistons. Thus, the pneumatic cylinder assembly 116 pushes the outer knife 110 upward so that it punctures the pipe 23 and overlaps the inner knife 80. The pneumatic cylinder assembly 135 pushes the support roller 130 downward, so that it is in circumferential contact with the spiral pipe 23. The pneumatic cylinder assembly 150 extends its piston, which pushes all of the components connected to the guide shafts 95, including the inner and outer knives and the support roller, in the axial direction of the pipe. As the pipe forming machine 10 continues to produce the pipe 23 in a spiral manner, the pipe moves axially with, and rotates between the overlapping inner knife 80 and the outer knife 110. After the pipe completes one revolution, the section of the pipe 23*a* in front of the overlapping knives will be completely severed and will fall into the slide 147.

Once the cutting process is complete, the air supplied to the pneumatic cylinder assemblies 116, 135 and 150 will be reversed. As a result, the support roller 130 and the outer knife 110 will be returned to their standby positions, and the piston 154 will pull all the components connected to the guide shafts 95, including both knives and the support roller, back to the begin-cut position.

To operate the cutting apparatus 75 in an automatic mode, an electrical encoder 27' is coupled to the lower drive roller 17 of the pipe producing machine 10 by a pulley belt 28'. The encoder 27' is adapted to generate pulses corresponding to the number of rotations of the lower drive roller 17. These pulses are transmitted over a cable 29' to a control box 44'. The control box 44' is programmed to check for a first pulse count corresponding to the desired length of the pipe, a second pulse count corresponding to a slow-down point for pipe production, and a third pulse count corresponding to the amount of axial travel of the pipe required for the pipe to be completely cut by the cutting apparatus 75. Three counters 45', 46' and 47' are included in the control box 44'. These counters can be incremented or decremented, one pulse at a time. The first pulse count (i.e., pipe length) is set with the first counter 45', the second pulse count (i.e., slow-down point) is set with the second counter 46', and the third pulse count (i.e., cut length) is set with the third counter 47'. The control box 44' sends pneumatic signals to the various pneumatic cylinders 117, 136 and 151 over line 48' in response to the first, second and third pulse counts.

The control box 44' also has four control switches 147', 148', 149', and 150'. A first control switch 147' selects manual or automatic control of the pipe cutting apparatus 75. In the manual mode, the second, third and fourth control switches 148', 149' and 150' are operable to manually actuate the various pneumatic cylinders 117, 136 and 151. That is, the second control switch 148' may be used to move the piston rod 118 in and out of its cylinder 117, and thereby move the outer knife 110 into and out of its cutting position. The third control switch 149' may be used to move the piston 154 in and out of its cylinder 151, and hence slide the inner knife 80, outer knife 110 and support roller 130 in the axial direction of the pipe 23. The fourth control switch 150' may be used to move the piston 137 in and out of its cylinder 136, and thereby move the support roller 130 in and out of its contact position. When the first control switch 147' is put into automatic mode, the second, third and fourth control switches 148', 149' and 150' are deactivated, and all three counters 45', 46' and 47' are reset to zero. The pipe cutting apparatus 75 will then automatically cut the pipe 23 into sections 23*a* as the pipe is produced on the pipe forming apparatus 10.

The control panel 13 is provided with an on/off switch for the pipe cutting machine 75 and three speed adjustment knobs 135', 136' and 137'. The first speed adjustment knob 135' controls the production speed of the pipe as it is formed with the pipe forming machine 10. The second speed adjustment knob 136' controls the speed at which the pipe is formed prior to the outer knife 110 moving from its standby position to its cutting position. In order to consistently obtain pipe sections that are cut to the same length, it is important that the pipe 23 travels at a constant, relatively slow speed while the outer knife 110 and support roller 130 move from their standby positions to the cutting position. A relatively low speed minimizes the effect of any pulse count errors on the length of the pipe sections 23*a*. Thus, prior to moving the outer knife 110 and support roller 130 to the cutting position, it is preferred that the pipe production is slowed from its fastest, most efficient production speed to a transitional, "slow-down speed". The second speed adjustment knob 136' controls this slow-down speed. The third speed adjustment knob 137' controls the speed of the pipe production while the outer knife 110 and support roller 130 move to, and are in, the cutting position where they cooperate with the inner knife 80 to cut the pipe 23. The cutting speed is usually set at one-half the production speed, or whatever speed is convenient. The speed control knobs 135', 136', 137' can be used to adjust the production speed, slow-down speed and cutting speed of the pipe cutting apparatus 75 during both manual and automatic modes of operation.

The cutting apparatus 75 operates in conjunction with the pipe producing machine 10 in automatic mode in the following manner. The spiral pipe forming . process is initiated with the pipe forming machine 10 in a known way. When the leading edge of the pipe 23 begins to leave the forming head 29, the pipe producing machine is temporarily halted, and the pipe cutting apparatus 75 is energized by turning on the on/off switch on the control panel 13. The pneumatic cylinder assemblies 116, 135 and 150 are initialized to be in their standby positions, so that the outer knife 110 does not overlap the inner knife 80. The first counter 45', the second counter 46', and the third counter 47' are set to zero. Air is sent to the axial motion cylinder 151 to fully retract piston 154, so that the inner and outer knives are in the begin-cut position.

Typically, the pipe cutting apparatus 75 will be initially operated in its manual mode to cut a few sections of pipe to determine the optimum positional adjustments for the inner knife 80, outer knife 110 and support roller 130. The pipe cutting apparatus 75 then is run in and out of automatic mode a few times to find the optimum settings for the production speed, slow-down speed, cutting speed, and the pulse counts for the pipe length, slow-down point, and cut length. Once these variables are determined, the pipe cutting apparatus 75 is ready for continuous automatic operation.

In a typical example of automatic operation, the first counter 45' may be set to 1250 pulses for pipe length, the second counter 46' may be set to 1100 pulses for the slow-down point, and the third counter 47' may be set to 375 pulses for the cut length. A cutting cycle begins by resetting all three counters 45', 46', 47' to zero, and by cutting the part of the pipe 23 that extends past the inner and outer knives while in the begin-cut position. This part of the pipe will be referred to as the "lead section".

When the pulse count is at zero in all three counters, the control box 44' sends a first pneumatic pulse signal, via line 48', to the pneumatic cylinder assemblies 116 and 135. The respective pistons 118 and 137 are thereby energized and pushed downward to their extended positions. The outer knife 110 and support roller 130 are thereby moved to the cutting position where the cutting edges of the inner and outer knives puncture the pipe 23. The first pneumatic pulse signal also reverses the direction of air supplied to the axial motion cylinder 151, so that the piston 154 pushes the shaft connector 96, and all components connected to the guide shafts 95, axially with the pipe. The pipe forming machine 10 continues to produce the pipe 23 in a spiral manner. The pipe 23 thus moves axially with, and rotates between, the overlapping inner knife 80 and the outer knife 110. The encoder 27' generates a train of pulses that correspond to the length of the next section of pipe being formed, which has its leading edge at the overlapping knives. This section of pipe will be referred to as the "new section". All three counters 45', 46', 47' count in unison as the new section of pipe is formed and the leading section of pipe is severed.

The guide shafts 95 allow the inner and outer knives to move in the axial direction of the pipe under the forces provided by the new section of pipe pushing on the overlapping knives and the extension of the axial motion piston 154. Thus, the inner knife 80, outer knife 110 and support roller 130 cooperate to cut the complete circumference of the leading section of pipe as the pipe moves axially and rotates between the inner and outer knives. Thus, the third pulse count will be set at the number of pulses corresponding to the axial travel corresponding to slightly more than one pipe rotation. It is generally preferred to have a little overlap in the cut to assure that the leading pipe section is completely severed.

When the third pulse count is reached, the third counter 47' stops counting, but the first and second counters 45' and 46' continue to count as the new section of pipe continues to be produced. Also, the control box 44' sends a second pneumatic pulse signal to the pneumatic cylinder assemblies 116, 135 and 150 line 48'. This second pneumatic signal indicates that the cutting process is completed, and thus operates the pneumatic cylinders 117, 136 and 151 to fully retract their respective pistons. The outer knife 110 and support roller 130 are then moved to their standby positions. The air supplied to the cylinder 151 is also reversed, so that the piston 154 pulls the cutting assembly 75 mounted on the guide shafts 95 back to its begin-cut position. When the third pulse count is reached, the new section of pipe also stops being produced at the cutting speed, and begins to be formed at the production speed.

The new section of pipe will continue to be produced at the production speed, and the first and second counters 45', 46' will continue to count pulses, until the second pulse count is achieved. At that time, the slow-down point will be reached. The second counter 45' will stop counting, and the new section of pipe will be formed at the slow-down speed.

The new section of pipe will continue to be formed at the slow-down speed, and the first counter 45' will continue to count pulses, until the first pulse count is reached. The first pulse count indicates that the new section of pipe has reached its desired length. When the first pulse count is reached, all three counters are reset to zero, and cutting process just described is repeated for the new section of pipe. The same cutting process will continue to be repeated as additional sections of pipe are produced.

The control scheme just described for the pipe cutting machine 75 is generally preferred because the pulse counts for the pipe length, slow-down point and cut length can be set independently, and the cut length is automatically accounted for in the pipe length. Moreover, the foregoing control scheme is preferred for cutting the spiral pipe into sections up to approximately five feet in length. For longer sections of pipe, the first pulse counter can be eliminated, and a limit switch connected to the pipe runoff table can be used to indicate that the desired pipe length has been reached. Other control schemes and considerations are disclosed in my patent application Ser. No. 127,744, at pages 25–29, filed Dec. 2, 1987. That part of application Ser. No. 127,744 is specifically incorporated by reference herein.

It should be understood that other changes and modifications to the preferred embodiment described above will be apparent to those skilled in the art. For example, a limit switch may be provided to limit the extent of axial travel of the pipe cutting apparatus 75 during the cutting operation to minimize the possibility of the machine jamming up. The limit switch would be mounted on the forming head table 28 so that it would be actuated by the shaft connector 96 or knife slide block 112.

It should be understood that changes and modifications to the preferred embodiment described above will be apparent to those skilled in the art. It is intended that the foregoing description be regarded as illustrative rather than limiting, and that it is the following claims, including all equivalents thereof, which are intended to define the scope of the invention.

I claim:

1. An apparatus for forming spiral pipe having a diameter of one inch or less from a strip of metal having lateral edge portions, the apparatus comprising:

a rotatable mandrel positioned inside a forming head;

a forming head for guiding the metal strip into a spiral pipe, said forming head completely surrounding the mandrel and having an inner diameter of approximately one inch or less;

compressing means for deforming and coupling the lateral edge portions of the metal strip, said compressing means being positioned only outside the metal strip as it is formed into a pipe; and means for driving the metal strip around the mandrel, against an interior surface of the forming head, and in an axial direction, wherein the lateral edge portions of the strip mate and are deformed and coupled by the compressing means to form a lockseam and provide a continuous spiral pipe.

2. The apparatus of claim 1 wherein the compressing means are mounted in the forming head.

3. The apparatus of claim 2 wherein the compressing means comprises only first roller means mounted in a lower portion of the forming head and second roller means mounted in an upper portion of the forming head, one of said roller means being operative to fold mated edge portions of the strip and the other of said roller means being operative to compress the folded edge portions of the strip into a lockseam.

4. The apparatus of claim 3 wherein the second roller means comprises a single roller operative to fold mated edge portions of the strip and the first roller means comprises two rollers which cooperate to fold the mated edges of the strip.

5. The apparatus of claim 4 wherein the rollers are passively rotatable.

6. The apparatus of claim 1 wherein the mandrel is passively rotatable.

7. The apparatus of claim 6 wherein the compressing means are only passively rotatable.

8. An apparatus for forming spiral pipe from a metal strip comprising:

a mandrel;

means mounting said mandrel for radially pivotable movement about an end of the mandrel and rotatable movement about the centerline of the mandrel in response to forces exerted thereon by contact with the metal strip;

a forming head having a lateral bore; and means for driving the metal strip around the mandrel and inside the lateral bore of the forming head to form a strip into a spiral pipe.

9. The apparatus of claim 8, wherein the mandrel is passively rotatable.

10. An apparatus for forming spiral pipe from a metal strip comprising:

a mandrel passively rotatable about its centerline, the mandrel providing a guide for an interior surface of the metal strip and a compression surface for forming a lock seam;

a forming head substantially surrounding the mandrel to provide an external guide for the metal strip, the forming head having an entrance for the metal strip and an interior surface which has a predetermined radius of curvature; and means for driving the metal strip into the forming head entrance, around the mandrel, against the interior surface of the forming head, and in an axial direction, wherein the outer edges of the strip mate to form a spiral cylinder, said driving means only contacting the metal strip prior to entry into the forming head entrance; and only passively rotatable compressing means external to the mandrel for deforming and coupling the mated edges of the strip to form a lockseam in a spiral pipe.

11. The apparatus of claim 10 wherein the compressing means only includes a first roller means mounted in a lower portion of the forming head and a second roller means mounted in an upper portion of the forming head, the first roller means being operative to fold the mated edges of the strip and the second roller means being operative to compress the folded edges of the strip into a lockseam.

12. The apparatus of claim 10, wherein the mandrel is pivotable about an end.

13. The apparatus of claim 12, wherein the mandrel is pivotable in any radial direction.

14. The apparatus of claim 10, wherein the forming head interior surface defines a lateral bore and completely surrounds the mandrel.

15. The apparatus of claim 10 wherein the compressing means comprises a first roller mounted in a lower portion of the forming head and a second roller mounted in an upper portion of the forming head, the first roller being operative to fold the mated edges of the strip and the second roller being operative to compress the folded edges of the strip into a lockseam.

16. The apparatus of claim 15 further comprising a third roller mounted in the lower portion of the forming head and cooperating with the first roller to fold the mated edges of the strip.

17. An apparatus for forming spiral pipe from a metal strip, wherein the pipe moves in an axial direction and rotates while it is being formed, comprising:

a mandrel;

means mounting said mandrel for radially pivotable movement about an end thereof in response to frictional forces exerted thereon by contact with the metal strip;

a forming head having a lateral bore; and means for forming the metal strip around the mandrel and inside the lateral bore of the forming head into a spiral pipe.

18. The apparatus of claim 17, wherein the mandrel is pivotable in any radial direction.

19. The apparatus of claim 14, wherein the diameter of the lateral bore is one inch or less.

20. The apparatus of claim 19, wherein an external surface of the mandrel and an interior surface of the lateral bore define a clearance approximately twice the thickness of the metal strip, plus 0.006 to 0.003 inches each side.

21. The apparatus of claim 17 wherein the mandrel is passively rotatable.

* * * * *

UNITED STATES PATENT AND TRADEMARK OFFICE

CERTIFICATE OF CORRECTION

PATENT NO. : 5,105,639
DATED : April 21, 1992
INVENTOR(S) : Wilhelmus P.H. Castricum It is certified that error appears in the above-indentified patent and that said Letters Patent is hereby corrected as shown below:

IN THE ABSTRACT

In line 14 of the Abstract, delete "endd" and insert --end--.

In column 1, line 14, after the first occurrence of "pipe" insert --.--.

In column 1, line 36, after "pipe" insert --.--.

In column 5, line 47, delete "81" and substitute --8-- therefor.

In column 5, line 58, delete "orientated" and substitute --oriented--.

UNITED STATES PATENT AND TRADEMARK OFFICE

CERTIFICATE OF CORRECTION

PATENT NO. : 5,105,639
DATED : April 21, 1992
INVENTOR(S) : Wilhelmus P.H. Castricum It is certified that error appears in the above-indentified patent and that said Letters Patent is hereby corrected as shown below:

In column 6, line 23, delete "the the" and substitute --the-- therefor.

In column 7, line 6, delete "S1" and substitute --81-- therefor.

In column 7, line 23, delete "needle" and substitute --needle/-- therefor.

Signed and Sealed this

Sixth Day of September, 1994

Bruce Lehman

*Attest:*

BRUCE LEHMAN

*Attesting Officer*

*Commissioner of Patents and Trademarks*